US008539774B2

(12) United States Patent
Carlisle

(10) Patent No.: US 8,539,774 B2
(45) Date of Patent: Sep. 24, 2013

(54) FUEL INJECTOR MOUNTING SYSTEM

(75) Inventor: Michael L. Carlisle, Derby (GB)

(73) Assignee: Rolls-Royce, PLC, London (GB)

( * ) Notice: Subject to any disclaimer, the term of this patent is extended or adjusted under 35 U.S.C. 154(b) by 0 days.

(21) Appl. No.: 13/358,942

(22) Filed: Jan. 26, 2012

(65) Prior Publication Data

US 2012/0204575 A1 Aug. 16, 2012

(30) Foreign Application Priority Data

Feb. 14, 2011 (GB) ..... 1102526.9

(51) Int. Cl.
*F02C 1/00* (2006.01)

(52) U.S. Cl.
USPC ..... 60/740; 60/796

(58) Field of Classification Search
USPC ..... 60/740, 796, 798, 800; 239/283, 239/390, 397, 600
See application file for complete search history.

(56) References Cited

U.S. PATENT DOCUMENTS

| | | | | |
|---|---|---|---|---|
| 3,116,606 | A * | 1/1964 | Dougherty et al. | 60/39.826 |
| 4,466,240 | A * | 8/1984 | Miller | 60/796 |
| 5,031,407 | A * | 7/1991 | Zaremba et al. | 60/739 |
| 5,197,288 | A * | 3/1993 | Newland et al. | 60/734 |
| 5,305,609 | A * | 4/1994 | Guinan et al. | 60/740 |
| 5,816,041 | A * | 10/1998 | Greninger | 60/775 |
| 6,553,769 | B2 * | 4/2003 | Halila et al. | 60/772 |
| 7,669,424 | B2 * | 3/2010 | Thornton | 60/796 |
| 2003/0217556 | A1 | 11/2003 | Wiebe | |
| 2007/0033940 | A1 * | 2/2007 | Duverneuil et al. | 60/743 |
| 2007/0256418 | A1 | 11/2007 | Mueller et al. | |
| 2011/0088407 | A1 * | 4/2011 | Carlisle | 60/796 |
| 2011/0088408 | A1 * | 4/2011 | Carlisle | 60/796 |
| 2011/0088409 | A1 * | 4/2011 | Carlisle | 60/796 |

FOREIGN PATENT DOCUMENTS

| | | | |
|---|---|---|---|
| EP | 0 488 557 | A1 | 6/1992 |
| EP | 1 719 888 | A2 | 11/2006 |
| EP | 2 312 216 | A2 | 4/2011 |
| EP | 2 312 217 | A2 | 4/2011 |
| EP | 2 314 924 | A2 | 4/2011 |

OTHER PUBLICATIONS

Search Report dated Mar. 26, 2012 issued in European Patent Application No. 12 15 2610.
British Search Report dated Jun. 1, 2011 issued in British Application No. 1102526.9.

* cited by examiner

*Primary Examiner* — Phutthiwat Wongwian
(74) *Attorney, Agent, or Firm* — Oliff & Berridge, PLC

(57) ABSTRACT

A system is provided for mounting fuel injectors to a gas turbine engine, including an engine casing having an aperture formed therein and a plurality of fuel injectors, each fuel injector having a respective flange for mounting the fuel injectors to the casing at the aperture so that the fuel injectors extend side-by-side into the engine. The flanges are dismountably sealed to an inner side of the casing. The aperture and the flanges are configured so that, when dismounted, each fuel injector is configured to rotate into an orientation relative to the aperture which allows each of the respective flanges to pass though the aperture and the fuel injector to be withdrawn from the casing. The flanges have respective sealing formations which engage with their neighboring flanges when the fuel injectors are mounted to the casing to close off the aperture and to form seals between the flanges.

15 Claims, 4 Drawing Sheets

FUEL INJECTOR MOUNTING SYSTEM

The present invention relates to a system for mounting a fuel injector to a gas turbine engine.

BACKGROUND OF THE INVENTION

With reference to FIG. 1, a ducted fan gas turbine engine generally indicated at 10 has a principal and rotational axis X-X. The engine comprises, in axial flow series, an air intake 11, a propulsive fan 12, an intermediate pressure compressor 13, a high-pressure compressor 14, combustion equipment 15, a high-pressure turbine 16, and intermediate pressure turbine 17, a low-pressure turbine 18 and a core engine exhaust nozzle 19. A nacelle 21 generally surrounds the engine 10 and defines the intake 11, a bypass duct 22 and a bypass exhaust nozzle 23.

The gas turbine engine 10 works in a conventional manner so that air entering the intake 11 is accelerated by the fan 12 to produce two air flows: a first air flow A into the intermediate pressure compressor 14 and a second air flow B which passes through the bypass duct 22 to provide propulsive thrust. The intermediate pressure compressor 13 compresses the air flow A directed into it before delivering that air to the high pressure compressor 14 where further compression takes place.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high, intermediate and low-pressure turbines respectively drive the high and intermediate pressure compressors 14, 13 and the fan 12 by suitable interconnecting shafts.

The combustion equipment 15 of such an engine typically has one or more combustion chambers, with fuel being delivered to the or each chamber by one or more fuel injectors.

As shown in FIG. 2, each fuel injector 24 is often mounted externally of a casing 25 of the combustion chamber 26 at a respective aperture through the casing. Each injector has a mounting flange 27 which is sealingly connected to the external surface of the casing with a feed arm 28 and tip 29 of the injector passing through the aperture and the tip engaging into the head 30 of the combustion chamber. Bolts 31 secure the flange via threads in the casing.

However, a problem with this arrangement is that the securing bolts 31 are working against the casing internal pressure. More particularly, the pressure difference across the casing 25 may be in the range from about 35 to 4100 kPa, with the high pressure within the casing forcing the injector flange 27 away from the casing. This can cause air leakage, and hence engine efficiency loss. On the other hand, an advantage of the arrangement is that the injector 24 can be removed on-wing for maintenance or replacement.

An alternative arrangement has the injector flange sealingly connected to the internal surface of the casing. This overcomes the air leakage problem because the sealing arrangement is working with the internal pressure, i.e. the pressure difference across the casing forces the flange toward the casing. However, the internally mounted injector cannot be easily removed as the flange is too large to be withdrawn through the aperture. Thus the injector can only be removed from the inside, which requires a major engine strip, rendering on-wing maintenance or replacement effectively impossible.

Thus there is a need to provide a system for mounting a fuel injector to a gas turbine engine which facilitates on-wing removal of the injector while reducing air leakage.

BRIEF SUMMARY OF THE INVENTION

In a first aspect, the present invention provides a system for mounting fuel injectors to a gas turbine engine, the system including:

an engine casing having an aperture formed therein, and a plurality of fuel injectors having respective flanges for mounting the fuel injectors to the casing at the aperture so that the fuel injectors extend side-by-side into the engine;

wherein:

the flanges are dismountably sealed to an inner side of the casing, the aperture and the flanges are configured so that, when dismounted, each fuel injector can be rotated into an orientation relative to the aperture which allows the respective flange to pass though the aperture and the fuel injector to be withdrawn from the casing, and the flanges have respective sealing formations which engage with their neighbouring flanges when the fuel injectors are mounted to the casing to close off the aperture and to form seals between the flanges.

Thus advantageously the fuel injectors are internally mounted, which can significantly reduce leakage and hence reduce engine efficiency losses, while also being removable from the outside of the casing, which facilitates on-wing maintenance.

The system may have any one or, to the extent that they are compatible, any combination of the following optional features.

Typically, the fuel injectors are fuel spray nozzles.

The flanges can be configured such that, one after another, the injectors can be rotated into said orientation and then withdrawn from the casing.

Conveniently, the aperture and flanges may be configured so that the rotation of each fuel injector to bring it into said orientation includes a rotation by about 90° about a radial direction of the engine passing though that fuel injector.

Typically, when the flanges are sealed to the casing, each flange covers an area of the aperture which is about the total area of the aperture divided by the number of fuel injectors.

Generally, each flange is non-circular, having a major diameter and an orthogonal minor diameter, the minor diameters of the flanges being aligned when the flanges are sealed to the casing such that the combined flanges has a first diameter which is about the same as the major diameter of each flange and an orthogonal second diameter which is about the sum of the minor diameters of the flanges, the flanges being configured such that the second diameter is greater than the first diameter. For example, typically, the minor diameter of each flange is less than the aperture diameter which is aligned with the first diameter of the combined flanges when the flanges are sealed to the casing. In this way, each fuel injector can be rotated into an orientation in which the minor diameter of its flange is parallel with said aperture diameter, allowing the flange to pass though the aperture and the fuel injector to be withdrawn from the casing.

Typically, the flanges are substantially rectangular or D-shaped.

Preferably the system further includes respective sealing strips between neighbouring flanges, the strips promoting the seals between the neighbouring flanges when they are engaged at their sealing formations. Additionally or alternatively, the system may further include fasteners, such as bolts, joining the neighbouring flanges together at the sealing formations.

The system may include just two fuel injectors having respective flanges for mounting the fuel injectors to the casing at the aperture. Alternatively, however, there may be more than two injectors for mounting at the aperture. When there are more than two injectors, these may be mountable at the casing in a line.

The engine casing may have a plurality of apertures, each having respective fuel injectors.

The respective flanges may be parallel to one another; alternatively the respective flanges may be angled relative to one another.

In a second aspect, the present invention provides an engine casing of the system of the first aspect.

In a third aspect, the present invention provides a fuel injector of the system of the first aspect.

In a fourth aspect, the present invention provides a gas turbine engine having the system of the first aspect.

BRIEF DESCRIPTION OF THE DRAWINGS

Embodiments of the invention will now be described by way of example with reference to the accompanying drawings in which.

DETAILED DESCRIPTION OF EXEMPLARY EMBODIMENT

Figure 1:
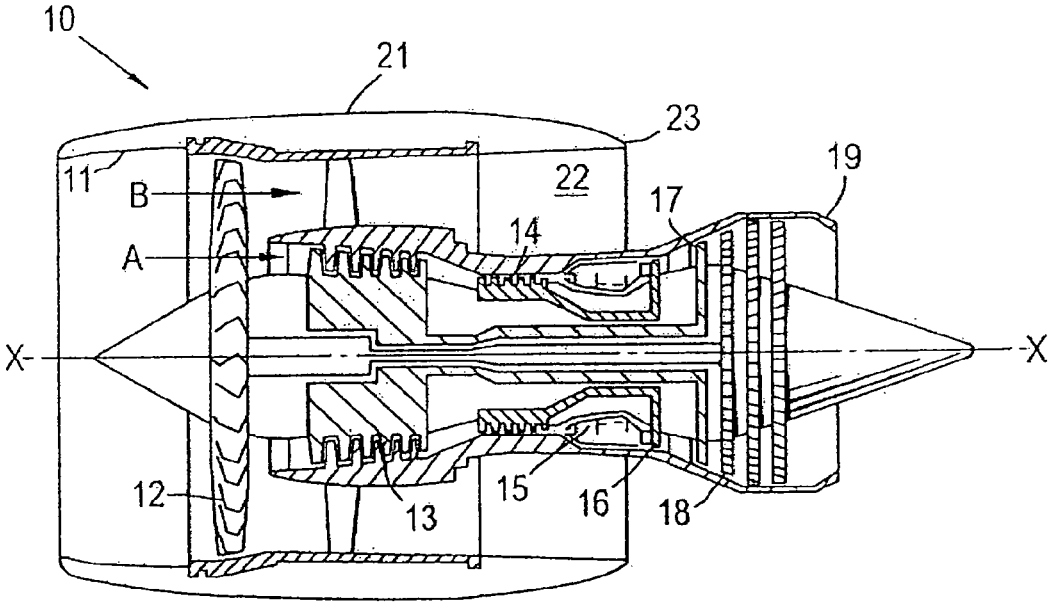
FIG. 1 shows a longitudinal cross-section through a ducted fan gas turbine engine.
Figure 2:
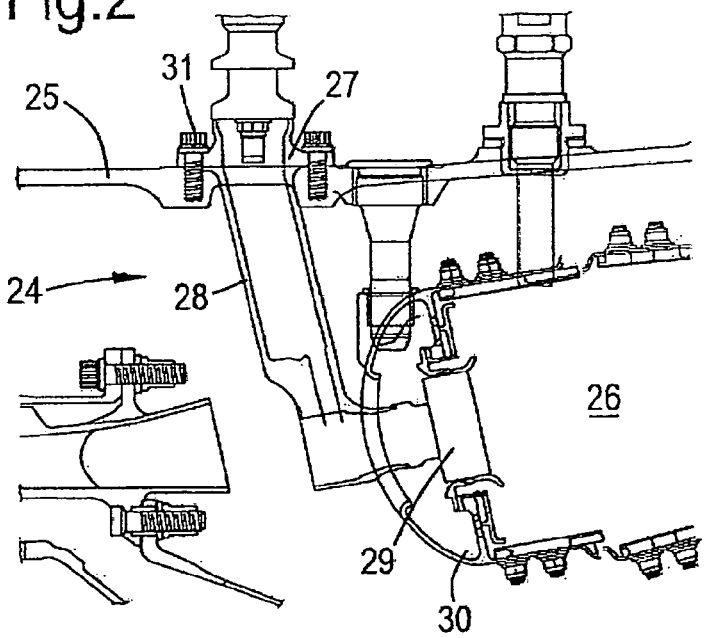
Related Art Fig.2
FIG. 2 shows a cross-sectional view of a system for mounting a fuel injector to a gas turbine engine.
Figure 3:
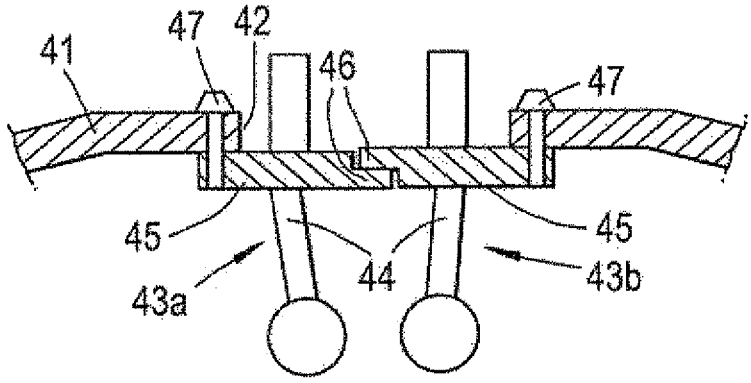
FIG. 3 shows a schematic partial transverse cross-sectional view of a gas turbine engine combustor stage, and illustrates a system for mounting fuel spray nozzles to a casing of the engine.

FIG. 3 shows a schematic partial transverse cross-sectional view of a gas turbine engine combustor stage, and illustrates a system for mounting fuel spray nozzles to a casing of the engine.

An engine casing 41 has a plurality of circumferentially spaced, substantially rectangular apertures 42 (only one shown in FIG. 3). Each aperture is the mounting position for two neighbouring fuel spray nozzles 43*a*, 43*b* having feed arms 44 which extend side-by-side into the engine.

Each nozzle 43*a*, 43*b* has a flange 45 which is also substantially rectangular and which, when mounted to the inner side of the casing, engages with the neighbouring flange to close off the aperture 42 and to form a seal between the flanges. The seal can be formed, for example, by matching overlapping formations 46 along facing edges of the flanges. The seal can be supplemented by a sealing strip (not shown) running the length of the edges and/or by bolts (not shown) passing through the overlapping formations.

Figure 4:
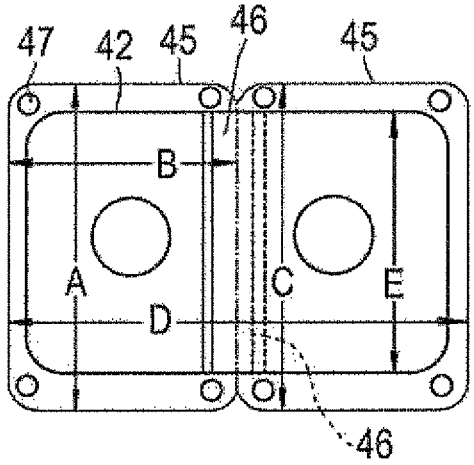
FIG. 4 shows a schematic exterior view of the system of FIG. 3.
Figure 5A:
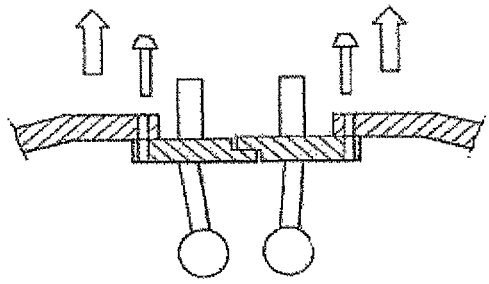
FIGS. 5(*a*) to (*d*) shows successive steps in the removal of the fuel spray nozzles of FIG. 3 from the casing.
Figure 5B:
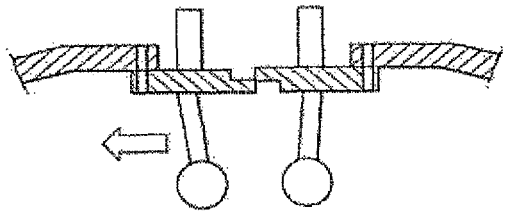
Figure 5C:
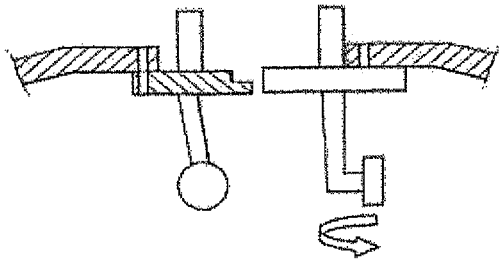
Figure 5D:
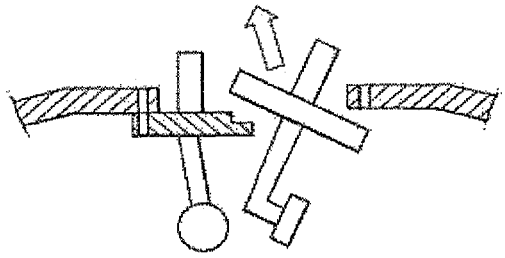

FIG. 4 shows a schematic view from outside the casing 41 of the aperture 42 and the flanges 45 (indicated by dashed lines) of the two nozzles 43*a*, 43*b*. The positions of securing bolts 47 which secure the flanges to the casing are also indicated. Each flange has a major diameter A and a smaller orthogonal minor diameter B. As the overlapping formations 46 are along the long edges of the flanges, the minor diameters B are aligned. Thus, the combined flanges have a first diameter C which is about the same as the major diameter A and an orthogonal second diameter D which is twice the minor diameter B. Further, the second diameter D is greater than the first diameter C.

The combined flanges 45 fully cover and seal the aperture 42. In addition, however, the minor diameter B of each flange is less than the aperture diameter E which is aligned with the first diameter C of the combined flanges. As explained below, this allows each nozzle 43*a*, 43*b* to be rotated 90° about the radial direction of the engine, so that the minor diameter B of its flange is parallel with the aperture diameter E, allowing the respective flange to pass though the aperture and the fuel injector to be withdrawn from the casing 41.

Successive steps in the removal of the nozzles 43*a*, 43*b* from the casing 41 are illustrated in FIGS. 5(*a*) to (*d*). Firstly the bolts 47 securing the flanges 45 to the inner side of the casing are removed (FIG. 5(*a*)). Next one of the nozzles 43*a* is shifted to the side, i.e. in the direction of second diameter D of the combined flanges (FIG. 5(*b*)). The other nozzle 43*b* is then rotated by 90° about the radial direction of the engine passing through the centre of the flange (FIG. 5(*c*)) so that the minor diameter B of its flange is parallel with the larger aperture diameter E. This allows the flange to be passed through the aperture and the nozzle 43*b* withdrawn (FIG. 5(*d*)). The first nozzle 43*a* can then be similarly rotated and withdrawn. The procedure allows the nozzle to be removed while the engine remains on-wing. To remount the nozzle to the casing, the removal procedure is reversed.

Suitably configured tools can facilitate the removal of the nozzles 43*a*, 43*b* from the casing 41. For example, nozzle tools can be screwed into inlet threads of the nozzles, allowing the nozzles to be securely held from outside the casing when they are manoeuvred as shown in FIGS. 5(*a*) to (*e*).

Figure 6:
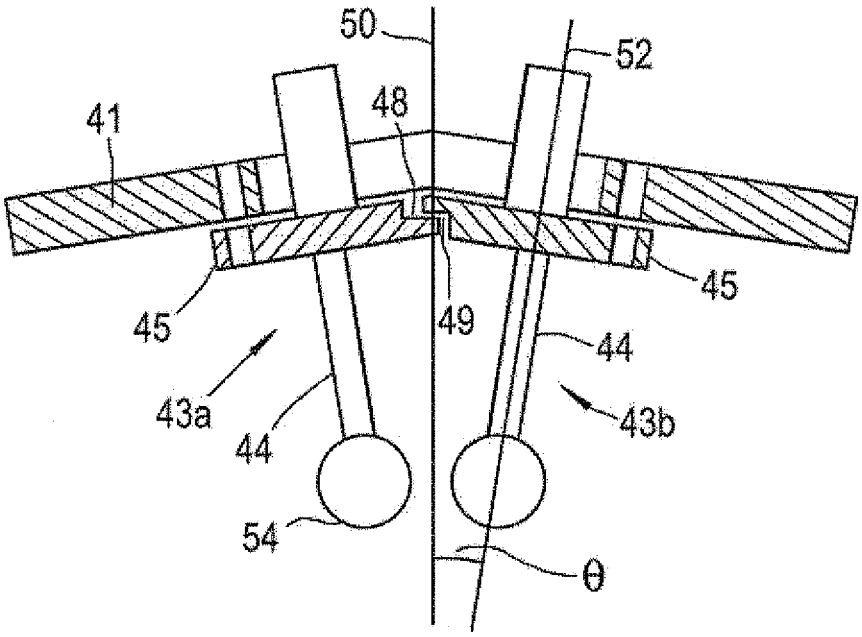
FIG. 6 shows a schematic partial transverse cross-sectional view of a gas turbine engine combustor stage, and illustrates an alternative system for mounting fuel spray nozzles to a casing of the engine.

FIG. 6 shows a schematic partial transverse cross-sectional view of an alternative system for mounting fuel spray nozzles to a casing of the engine. Common elements are given the same reference numbers as shown and described in FIG. 3. Each fuel spray nozzle assembly 43*a*, 43*b* comprises a delivery arm 44, a spray head 54 and the flange 45. The flanges engage with the neighbouring flanges on complimentary abutting surfaces 48 and 49 respectively. In FIG. 3 the flanges 45 and complimentary abutting surfaces 48, 49 are generally parallel to one another. In the FIG. 6 embodiment the flanges are shown non-parallel to one another. A first radial line 50 bisects the two fuel spray nozzles 43*a*, 43*b* and a centre-line 52 passes through the fuel spray nozzle 43*b* and subtends an angle θ is between the radial line 50 and the centre-line 52. In this case the centre-line 52 is also coincident with a radial line, but does not need to be. Where the other nozzle is similarly angled with respect to the radial line 50, the angle between the fuel spray nozzles is 2θ. The included angle between the flanges is 180° minus 2θ. This is where the flanges 45 lie in a plane normal to the centre-line 52.

The complimentary abutting surfaces 48, 49 are generally parallel to one another and lie in a plane that is generally normal to the radial line 50. Here the surfaces 48, 49 are each angled θ to their respective flange. Alternatively, one of the surfaces 48, 49 can be angled 2θ while the other is parallel to its flange 45. Other complimentary angles of the surfaces can also be utilised.

Figure 7:
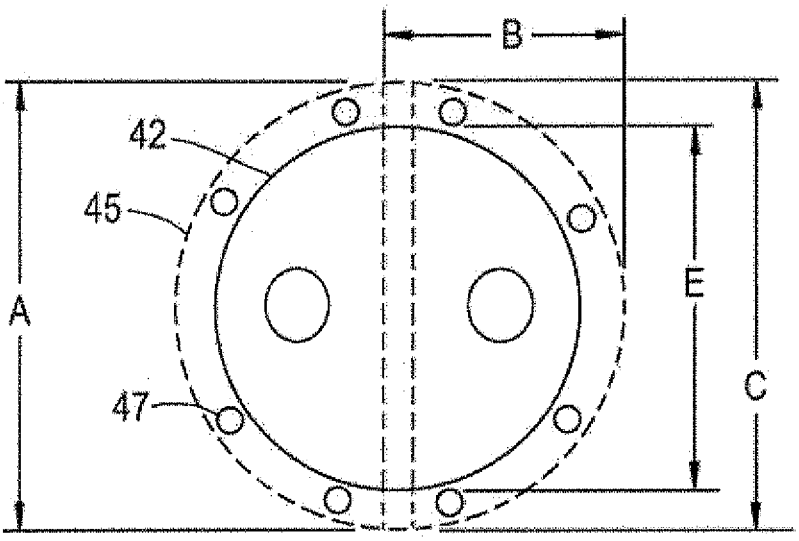
FIG. 7 shows a schematic exterior view of another system of FIG. 3.

Referring to FIG. 7 which shows a schematic exterior view of another system of FIG. 3, the same reference numerals in FIG. 4 have been used to denote similar elements. In this embodiment the flanges 45 are generally D-shaped in this view and overlap one another along their generally straight edges. The aperture 42 is generally circular, which can be a preferable shape to minimise stresses around corners and sharper radii. The reference letters A, B, C and D are intended to denote the same dimensions and this embodiment functions the same as that described and shown in FIG. 4 particularly with respect to assembly and disassembly. It should be apparent that other shapes of aperture 42 and therefore complimentary flange shapes are possible, such that the flanges cover the aperture and overlap one another.

Because the flanges 45 are mounted internally, the system can significantly reduce leakage flow through the aperture 42, which can benefit engine efficiency, and reduce temperatures outside the casing 1.

The system of FIGS. 3 to 7 has just two fuel spray nozzles 43*a*, 43*b* mounted at the aperture 42. However, it is possible for more than two nozzles to be mounted at each aperture, for example with their respective flanges in a line. The nozzles can then be rotated and withdrawn one after another using a similar procedure as illustrated in FIGS. 5(*a*) to (*d*).

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

The invention claimed is:

1. A system for mounting fuel injectors to a gas turbine engine, the system including:

an engine casing having an aperture formed therein, and a plurality of fuel injectors each having a respective flange for mounting a respective one of the fuel injectors to the casing at the aperture so that the fuel injectors extend side-by-side into the engine;

wherein:

each of the flanges are dismountably sealed to an inner side of the casing, the aperture and each of the flanges are configured so that, when dismounted, each fuel injector is configured to rotate into an orientation relative to the aperture which allows the respective flange to pass though the aperture and the fuel injector to be withdrawn from the casing, and each of the flanges have respective sealing formations, the sealing formations engage neighbouring flanges when the fuel injectors are mounted to the casing to close off the aperture and to form seals between the flanges.

2. A system according to claim 1, wherein each of the flanges are configured such that the injectors are configured to rotate into said orientation and withdrawn from the casing one after another.

3. A system according to claim 1, wherein the aperture and each of the flanges are configured so that the rotation of each fuel injector to bring it into said orientation includes a rotation by about 90° about a radial direction of the engine passing though that fuel injector.

4. A system according to claim 1, wherein, when the flanges are sealed to the casing, and each flange covers an area of the aperture which is about the total area of the aperture divided by the number of fuel injectors.

5. A system according to claim 1, wherein each flange is non-circular, having a major diameter and a minor diameter which is orthogonal to the major diameter, the minor diameters of the flanges being aligned when the flanges are sealed to the casing such that the combined flanges have a first diameter which is about the same as the major diameter of each flange and a second diameter that is orthogonal to the first diameter, the second diameter is about the sum of the minor diameters of the flanges, the flanges being configured such that the second diameter is greater than the first diameter.

6. A system according to claim 5, wherein the minor diameter of each flange is less than the aperture diameter which is aligned with the first diameter of the combined flanges when each of the flanges are sealed to the casing, such that each fuel injector is configured to rotate into an orientation in which the minor diameter of its respective flange is parallel with said aperture diameter, allowing that flange to pass though the aperture and the fuel injector to be withdrawn from the casing.

7. A system according to claim 1, wherein each of the flanges are substantially rectangular or D-shaped.

8. A system according to claim 1 further including respective sealing strips between neighbouring ones of the flanges, each strip promoting the seals between the neighbouring flanges when they are engaged at their sealing formations.

9. A system according to claim 1 which includes just two fuel injectors, each having a respective one of the flanges for mounting the fuel injectors to the casing at the aperture.

10. A system according to claim 1, wherein the engine casing has a plurality of apertures, each having a respective fuel injector.

11. A system according to claim 1, wherein each of the flanges are parallel to one another.

12. A system according to claim 1, wherein each of the flanges are angled relative to one another.

13. An engine casing of the system of claim 1.

14. A fuel injector of the system of claim 1.

15. A gas turbine engine having the system of claim 1.

* * * * *